US005115935A

United States Patent [19]

Lemongelli

[11] Patent Number: 5,115,935

[45] Date of Patent: May 26, 1992

[54] DISPOSABLE BAG BOX FOR TRASH RECEPTACLE

[76] Inventor: Ralph J. Lemongelli, Rte. 1, Monroe City, Mo. 63456

[21] Appl. No.: 523,895

[22] Filed: May 16, 1990

[51] Int. Cl.[5] ..... B61D 25/16

[52] U.S. Cl. ..... 220/407; 220/908; 229/112

[58] Field of Search ..... 220/407, 908; 229/112

[56] References Cited

U.S. PATENT DOCUMENTS

| | | | |
|---|---|---|---|
| 1,465,231 | 8/1923 | Oglesby | 229/112 |
| 1,994,803 | 3/1935 | Atkins | 229/112 |
| 3,392,825 | 7/1968 | Gale et al. | 220/407 |
| 3,800,503 | 4/1974 | Maki | 220/407 |
| 4,105,155 | 8/1978 | Forbes, Jr. | 229/112 |
| 4,850,507 | 7/1989 | Lemongelli et al. | 220/407 |
| 4,869,391 | 9/1989 | Farrington | 220/407 |
| 4,955,505 | 9/1990 | Battaglia | 220/407 |

*Primary Examiner*—Joseph Man-Fu Moy
*Attorney, Agent, or Firm*—Litman, McMahon & Brown

[57] ABSTRACT

A disposable bag box is trapezoidal in shape to permit easy and releaseable engagement in a cavity at the bottom of a trash receptacle. The trapezoidal box is adapted to be low in height, thus providing more easily accessible trash receiving receptacle volume.

8 Claims, 2 Drawing Sheets

DISPOSABLE BAG BOX FOR TRASH RECEPTACLE

BACKGROUND OF THE INVENTION

This invention is directed to a trash receptacle adapted to self-store a box of disposable liner bags, and particularly to a box for use with such receptacles which is easily and releaseably received and locked into a cavity in the bottom of the container for dispensing trash bags therefrom.

An example of a receptacle adapted to self-store a box of disposable liner bags is disclosed in U.S. Pat. No. 4,850,507 to Lemongelli. The '507 reference discloses an assembly wherein a box of disposable liner bags is placed in the cavity of a receptable for dispensing bags for use in the receptacle. The stored liner bag box is adapted for easy mounting in a convenient position in the bottom of the container and for automatic withdrawal of bags. The liner bag box is retained in position by simple insertion of the box longitudinally of receptacle. The liner bag box is provided with a series of folded trash bags, each of which is divided by a perforated division for easy detachment of individual bags. The cavity is provided with tabs which urge against the walls of the liner bag box once the box is inserted in the cavity for the purpose of preventing the box from freely exiting the cavity when the bags are dispensed. The assembly disclosed in the '507 reference includes an assembly in which the box may be inserted from the top and another assembly in which the box may be inserted from the bottom.

However, not all box materials of construction possess the necessary elasticity to allow easy insertion of the box into the cavity or prevent the box from freely exiting during bag dispensing. In addition, the elastic properties of a box prior to installation may be diminished during use of the box by the absorption of moisture in the box.

Although these problems are less pronounced if the bottom insertion assembly is used, the bottom insertion assembly is less desirable because it is more difficult to align the box during the insertion. In addition, the bottom insertion assembly is less desirable because such receptacles lack a receptacle bottom seal.

OBJECTS OF THE INVENTION

The principle objects of the present invention are: to provide an improved receptacle adapted to self-store a box disposable liner bags; to provide such an improved receptacle which lessens the effort required to releasably engage a bag containing box into a box receiving cavity in the refuse container; to provide a bag containing box adapted to store and dispense rolls of trash bags which are commercially available; to provide a box which is low in height permitting more easily accessable trash receiving volume in the receptacle; and to provide an assembly with a receptacle having a sealed bottom.

Other objects and advantages of this invention will be apparent from the following description taken in conjunction with the accompanying drawings wherein are set forth, by way of illustration and example, certain embodiments of this invention.

SUMMARY OF THE INVENTION

This invention is a trash receptacle assembly adapted to self-store a box of disposable liner bags which, in one preferred form, involves the use of a trapezoidal shaped box for releasable insertion into a cavity located in the bottom of the receptacle. The walls forming the cavity include inwardly directed tabs located at the upper most edge of the box which retain the box against unwanted removal. In the preferred form, the trapezoidal shaped box is inserted downward from the upper opening in the trash receptacle. As the box is lowered into the cavity, the lower surface of the box passes unrestrained through the opening defined by the tabs. The upper surface of the box is adapted to be tightly received by the cavity and held in place by the tabs when the box is fully inserted. Once the box is fully inserted, bags may be dispensed from one of two slots provided on the upper surface of the box. The tabs are adapted to allow easy removal of the box for replacement.

DESCRIPTION OF THE PREFERRED EMBODIMENTS

Figure 1:
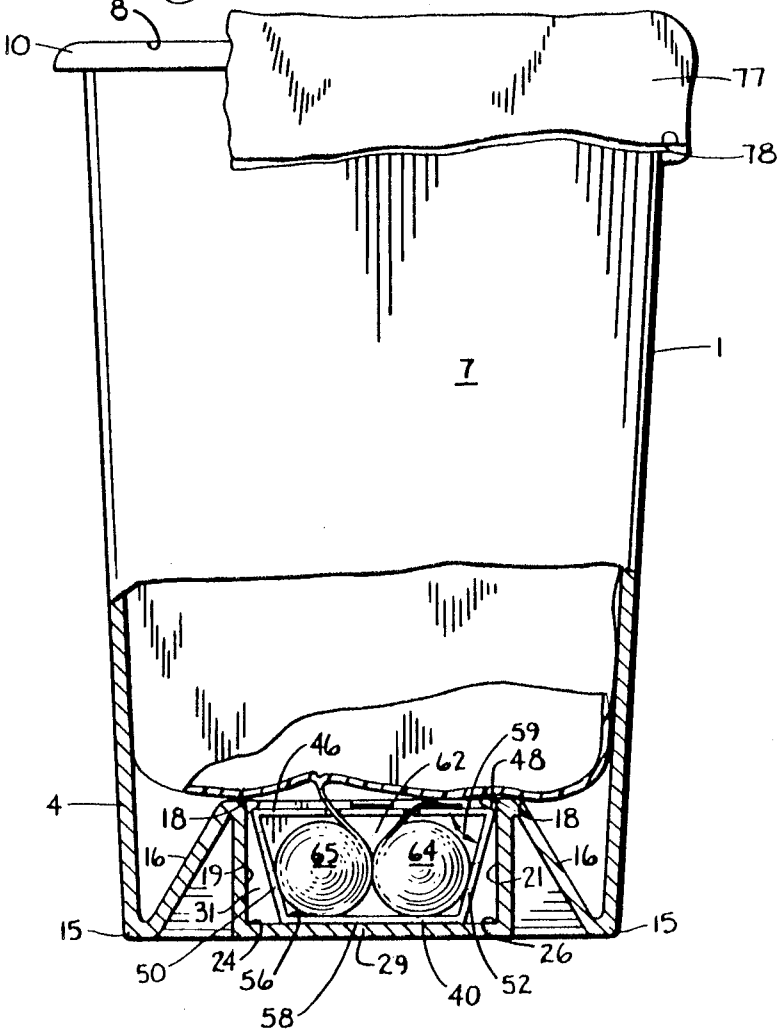
FIG. 1 is a side elevational view with portions broken away to reveal interior construction.

Referring to FIG. 1, an example of a trash receptacle 1 embodying this invention is shown having a wall, which wall in this instance comprises a conventional rectangular shape with upwardly and outwardly sloping walls 4, 5, 6 and 7. Walls 4–7 terminate at upper edges 8 to form a rectangular upper trash receiving opening 9. A curved lip 10 is preferably formed at the upper edge 8 to add structural rigidity to the receptacle 1 and reduce the risk of injury or back cutting through exposed sharp edges.

The receptacle may be fabricated for many suitable material, however, in this example, it is formed of molded synthetic resin allowing inexpensive construction.

The walls 4–7 terminate at lower edges 15 which contact the surface upon which the receptacle rests and offers stable support.

In the embodiment of FIG. 1, a false bottom 16 is integral with, and projects diagonally upwardly and inwardly from lower edges 15, producing a frame like configuration with an interior edge 18. At the inner edge 18, cavity walls 19, 20, 21 and 22 depend therefrom and terminate at lower edges 24, 25, 26 and 27, respectively, generally at the same level as lower edges 15 of the walls 4–7. A bottom 29 is integral with cavity walls 19–20 forming a box receiving cavity 31 for receiving a bag containing box 40. Inwardly directed box engagement tabs 42 are spaced about the upper edge 18 of the cavity walls 19–22 and form obstructions that latchably receive and retain the box 40 in the cavity 31 to resist disengagement of the box 40 from cavity 31. The tabs 42, however, are not sufficiently obstructive to prevent removing of box 40 upwardly by hand for replacement with a full box.

Figure 3:
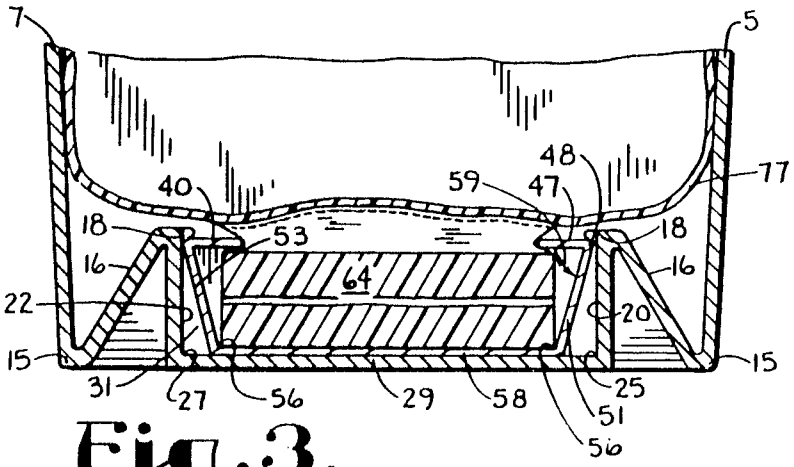
FIG. 3 is a fragmentary cross-sectional view taken longitudinally through the bag box and a bag roll contained therein, showing the trapezoidal construction of the box as it is retained by the tabs.
Figure 8:
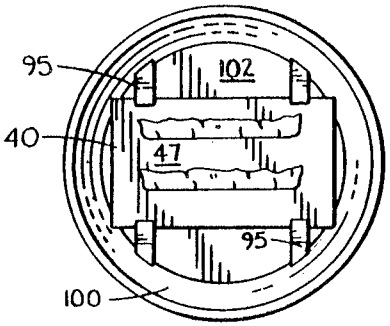
FIG. 8 is a top view of another alternative embodiment showing a box receiving cavity being integral with a bottom portion of a receptacle having a wall portion of endless configuration.
Figure 5:
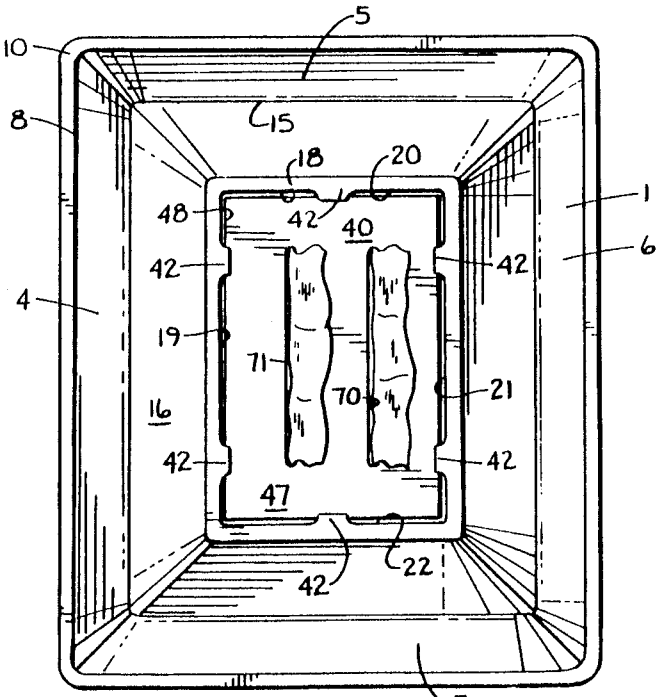
FIG. 5 is a top plan view of the receptacle shown in FIG. 2.
Figure 4:
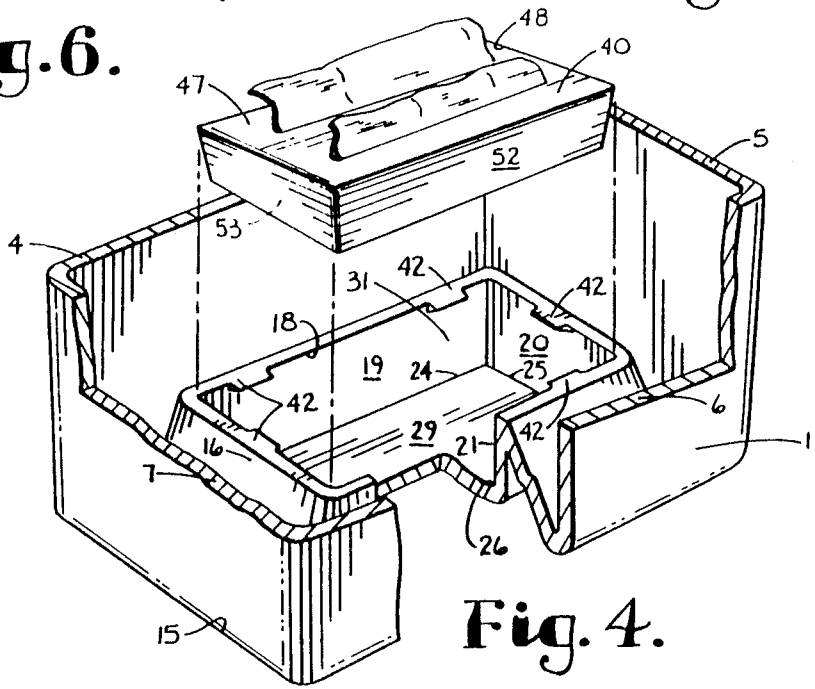
FIG. 4 is a fragmentary exploded perspective view showing the bag box aligned for insertion downwardly from the open top of the receptacle.

The box 40 comprises an upper wall 47 generally rectangular in shape with an outer edge 48 and of a size which can be snugly interposed within edge 18 of cavity 31. Intermediate box walls 50, 51, 52, and 53, are integral to and depend from upper wall 47 at its outer edge 48 and terminate at a lower edge 56. The lower wall 58 is integral with box walls 50, 51, 52 and 53. Lower wall 58 is generally rectangular in shape and is of a sufficiently small surface area such that the lower edge 56 is not obstructed by tabs 42 when box 40 is inserted into cavity 31. Because the lower wall 58 is smaller in surface area than upper wall 47, the box 40 appears to be tapered and trapezoidal in shape when viewed from any side and is thus wedgably and releaseably received by the cavity 31. In addition, the upper wall 47, in cross section normal to edge 48, forms an angle 59 with walls 50–53 less than 90°, as shown in FIGS. 3 and 4. It is foreseen that the individual angles between the upper wall 47 and each wall 50–53 may be different from one another.

Further, however, it is foreseen that the lower wall 58 and walls 50 through 53 may assume other geometric shapes, such as hemispherical, which shapes can likewise be wedgably received by cavity 31. The bottom facing surfaces of box 40 may assume any shapes which will not initially be obstructed by tabs 42 upon insertion of box 40 into cavity 31.

Figure 2:
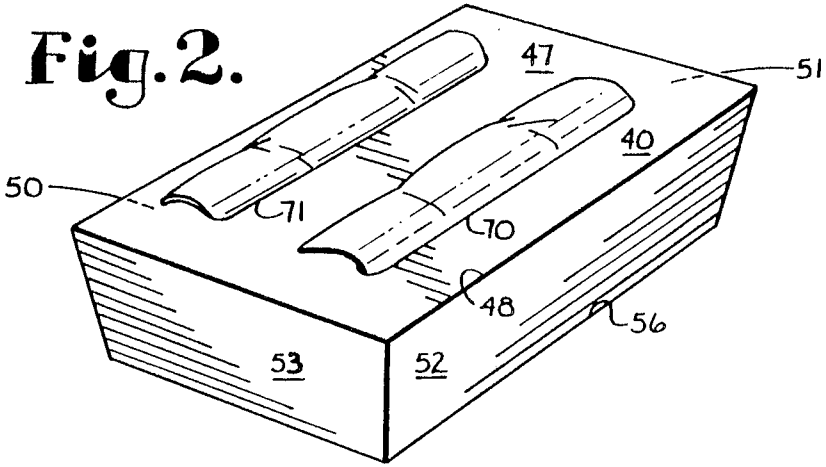
FIG. 2 is a perspective view of a trapezoidal shaped box of the preferred embodiment of this invention.

Located within the interior volume 62 of the box 40 is a first bag roll 64 and a second bag roll 65, each comprising rolls of commercially available trash bags, the individual bags for which are separated by a perforated division allowing for easy bag detachment (not shown). The individual bags are dispensed from rolls 64 and 65 through a first parallel slot 70 and a second parallel slot 71 located in the upper surface 47, as shown in FIG. 2.

As box 40 is inserted in cavity 31, the lower wall 58 passes tabs 42, which tabs 42 eventually urge against box walls 50–53. However, the elasticity of box walls 50–53 allow the box 40 to be fully inserted with the tabs 42 ultimately overlapping the upper wall 47, as shown in FIG. 3.

After the box 40 is inserted, a top bag 77 from the first roll 64 may be grasped and withdrawn upwardly through first parallel slot 70 and expanded within the receptacle in the usual manner, normally by pulling the bag upper edge 78 downwardly over upper edge 8 of the receptacle, covering the upper edge and interior surfaces of the container. Perforations or other weakening systems (not shown) allow the old and new bag to be easily separated.

When the bag is full of refuse (not shown), the upper edge 78 of the bag may be gathered in the usual manner, tied, bag lifted out of the receptacle for disposal. The act of withdrawing the full bag automatically pulls the next bag upwardly for replacement and use within the container. When the first roll 64 is completed, the process may be repeated with the second roll 65.

When the box 40 is empty of bags, it may be grasped by the fingers through slots 70 and 71 and pulled upwardly out of the cavity 31 for discard and replacement.

Figure 6:
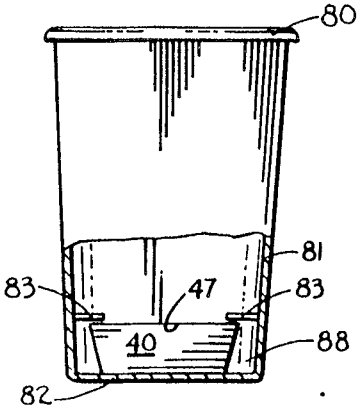
FIG. 6 is a side elevational view of an alternative embodiment showing a box receiving cavity being integral with a bottom portion of the receptacle having four walls.

In an alternative embodiment shown in FIG. 6, a four walled receptacle 80 with a wall portion 81 and a flat bottom 82 includes inwardly directed tabs 83 fixedly attached to wall portion 81 in the proximity of bottom 82 to define a cavity 88.

Figure 7:
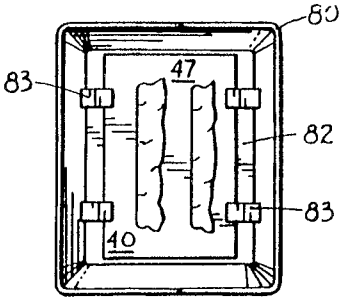
FIG. 7 is a top view of FIG. 6.

In yet another alternative embodiment shown in FIG. 7, the box 40 is wedgably received by inwardly directed tabs 95 fixedly attached to continuous wall 95 of a round receptacle 100, defining a cavity 102 near the bottom of a continuous wall 90.

Box 40 may be inserted into cavity 88 and cavity 102 in the alternative embodiments in a manner similar to that described for cavity 31.

Although certain embodiments of this invention have been illustrated and described, it should be understood that the scope of this invention is not to be limited thereto, except insofar as such limitations are included in the form of claims.

What is claimed and desired to be secured by letters patent is as follows:

1. In combination, a trash receptacle adapted to be lined by a disposable trash bag and a bag containing box:
   (a) said trash receptacle comprising a receptacle wall having an upper edge and a lower edge;
   (b) cavity forming means integral with said wall at said lower edge and forming a box receiving cavity;
   (c) said cavity means including box engagement means; and
   (d) said bag containing box having a tapered configuration whereby said box, upon entrance into said cavity is wedgably received in said cavity.

2. The combination as set forth in claim 1, wherein:
   (a) said box engagement means comprises at least one tab projecting inwardly from said cavity means, said tab being adapted to latchably engage said box and prevent same from freely exiting said cavity.

3. The combination as set for in claim 1 wherein said cavity, including:
   (a) an upwardly extending cavity wall portion spaced inwardly of and depending from said receptacle wall;
   (b) a cavity bottom portion integrally connected to said upwardly extending cavity wall portion.

4. The combination as set forth in claim 1, wherein:
   (a) said box means comprises an upper wall portion, a lower wall portion, said upper and lower wall portion being attached by an intermediate wall portion, said lower wall portion being smaller in surface area than said upper wall portion.

5. The box means as set forth in claim 4, wherein:
   (a) first and second generally parallel slots are positioned on and communicate through said upper wall portion for dispensing trash bags stored within said box means.

6. The receptacle assembly as set forth in claim 1, wherein:
   (a) said box being adapted for storing and dispensing at least two rolls of trash bags thereby permitting said cavity forming means to be low in height for more easily assessable trash receiving volume in said receptacle.

7. The receptacle assembly as set forth in claim 1, wherein:

(a) said receptacle wall and said cavity forming means being integrally sealed to resist the release of fluids therefrom.

8. In combination, a trash receptacle adapted to be lined by a disposable trash bag and a bag containing box:

(a) said trash receptacle comprising a receptacle wall with an upper edge and a lower edge;

(b) cavity forming means integral with said receptacle wall at said lower edge and forming a box receiving cavity; said cavity forming means comprising an upwardly extending cavity wall portion spaced inwardly of and depending from said receptacle wall; a cavity bottom portion integrally connected to said upwardly extending cavity wall portion; said receptacle wall and said cavity forming means being integrally sealed to resist the release of fluids therefrom;

(c) box engagement means associated with said cavity forming means; said box engagement means comprising at least one tab projecting inwardly from said cavity means; said tab being adapted to latchably engage said box means and prevent same from freely exiting said cavity forming means;

(d) a bag containing box having a tapered configuration whereby said box, upon entrance into said cavity forming means, is wedgably received in said cavity by said engagement means for releaseable engagement therefrom; said box comprising an upper wall portion, a lower wall portion; said upper and lower wall portion being attached by an intermediate wall portion; said lower wall portion being smaller in surface area than said upper surface portion; at least one slot positioned on and communicating through an upper wall portion for dispensing trash bags stored within said box; said box means being adapted for storing and dispensing at least one roll of trash bags thereby permitting the cavity means to be low in height for more easily assessable trash receiving volume in said receptacle means.

* * * * *